US012221312B2

(12) United States Patent
Nishimura et al.

(10) Patent No.: US 12,221,312 B2
(45) Date of Patent: Feb. 11, 2025

(54) SHEET CONVEYING DEVICE, IMAGE FORMING APPARATUS

(71) Applicant: KYOCERA Document Solutions Inc., Osaka (JP)

(72) Inventors: Takuya Nishimura, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 145 days.

(21) Appl. No.: 18/042,190

(22) PCT Filed: Jun. 30, 2021

(86) PCT No.: PCT/JP2021/024746
§ 371 (c)(1),
(2) Date: Feb. 17, 2023

(87) PCT Pub. No.: WO2022/044535
PCT Pub. Date: Mar. 3, 2022

(65) Prior Publication Data

US 2024/0025683 A1 Jan. 25, 2024

(30) Foreign Application Priority Data

Aug. 26, 2020 (JP) ..... 2020-142287

(51) Int. Cl.
*B65H 43/04* (2006.01)
*B65H 7/10* (2006.01)
(Continued)

(52) U.S. Cl.
CPC ..... *B65H 43/04* (2013.01); *B65H 7/10* (2013.01); *B65H 9/006* (2013.01); *B65H 9/103* (2013.01);
(Continued)

(58) Field of Classification Search
CPC . B65H 7/10; B65H 9/006; B65H 9/10; B65H 9/103; B65H 9/106; B65H 29/125;
(Continued)

(56) References Cited

U.S. PATENT DOCUMENTS

2003/0080487 A1* 5/2003 Tamura ..... B26D 7/2628 270/58.12
2007/0075482 A1* 4/2007 Fujita ..... B65H 29/12 271/220

(Continued)

FOREIGN PATENT DOCUMENTS

JP 2018095466 A 6/2018

*Primary Examiner* — Prasad V Gokhale
(74) *Attorney, Agent, or Firm* — Alleman Hall & Tuttle LLP

(57) ABSTRACT

An object of the present invention is to correct the deviation of a sheet in the width direction occurring on a conveyance path from a sheet correction mechanism (4) to a discharge tray. A sheet shift portion (41, 43, 44) moves a sheet in the width direction. A conveying position detecting portion (45, 46, 47) detects the position of the sheet in the width direction. A discharge position detecting portion (54, 8*a*) detects a discharge position of the sheet, in the width direction, discharged onto a discharge tray (33) in a sheet discharge portion (31). A control portion (8*b*) derives an amount of deviation between the discharge position and a discharge reference position based on a detection result of the discharge position detecting portion (54, 8*a*). Furthermore, the control portion (8*b*) corrects a conveying position of the sheet in a sheet conveying portion according to the amount of deviation.

7 Claims, 3 Drawing Sheets

(51) Int. Cl.

| | |
|---|---|
| ***B65H 9/00*** | (2006.01) |
| ***B65H 9/10*** | (2006.01) |
| ***B65H 9/16*** | (2006.01) |
| ***B65H 29/12*** | (2006.01) |
| ***B65H 31/20*** | (2006.01) |
| ***B65H 31/34*** | (2006.01) |

(52) U.S. Cl.
CPC ..... *B65H 9/166* (2013.01); *B65H 29/125* (2013.01); *B65H 31/20* (2013.01); *B65H 31/34* (2013.01); *B65H 2301/331* (2013.01); *B65H 2404/1422* (2013.01); *B65H 2404/1424* (2013.01); *B65H 2511/12* (2013.01); *B65H 2511/24* (2013.01); *B65H 2515/34* (2013.01); *B65H 2601/272* (2013.01); *B65H 2801/06* (2013.01)

(58) Field of Classification Search
CPC ..... B65H 31/20; B65H 31/34; B65H 43/04; B65H 2301/331; B65H 2301/3613; B65H 2404/1422; B65H 2404/1424; B65H 2405/114; B65H 2405/1144; B65H 2511/12; B65H 2511/24; B65H 2515/34; B65H 2553/81; B65H 2601/272
See application file for complete search history.

(56) References Cited

U.S. PATENT DOCUMENTS

| | | | | |
|---|---|---|---|---|
| 2013/0285314 | A1* | 10/2013 | Tokuma ..... | B65H 31/34 271/220 |
| 2017/0152119 | A1* | 6/2017 | Kubota ..... | B65H 31/34 |
| 2021/0024318 | A1* | 1/2021 | Haruna ..... | B65H 33/08 |

* cited by examiner

SHEET CONVEYING DEVICE, IMAGE FORMING APPARATUS

TECHNICAL FIELD

The present invention relates to a sheet conveying device provided with a mechanism for correcting deviation of sheets in a width direction and an image forming apparatus provided with the same.

BACKGROUND ART

In an image forming apparatus, the positions of sheets that are being conveyed by a sheet conveying device may be shifted in the width direction of the sheets.

In addition, the sheet conveying device is known to be provided with a sheet correction mechanism for correcting the positions of the sheets in the width direction (for example, see PTL 1).

CITATION LIST

Patent Literature

[PTL 1] Japanese Patent Application Publication No. 2018-95466

SUMMARY OF THE INVENTION

Problems to be Solved by the Invention

In a case where the conveyance path of the sheets downstream of the sheet correction mechanism is long, the positions of the sheets in the width direction may be shifted again before the sheets are discharged to a discharge tray.

An object of the present invention is to provide a sheet conveying device capable of correcting the deviation of a sheet in the width direction occurring on a conveyance path of the sheet from a sheet correction mechanism to a discharge tray and to provide an image forming apparatus provided with the sheet conveying device.

Solution to the Problems

A sheet conveying device according to an aspect of the present invention is provided with a sheet conveying portion, a sheet discharge portion, a sheet shift portion, a conveying position detecting portion, a discharge position detecting portion, and a control portion. The sheet conveying portion conveys a sheet along a conveyance path. The sheet discharge portion is disposed downstream of the sheet conveying portion in a sheet conveying direction and discharges the sheet from a discharge port to a discharge tray. The sheet shift portion is disposed on the conveyance path and moves the sheet in a width direction orthogonal to the sheet conveying direction. The conveying position detecting portion detects the position of the sheet in the width direction on the conveyance path. The discharge position detecting portion detects a discharge position of the sheet, in the width direction, discharged onto the discharge tray in the sheet discharge portion. The control portion controls the conveyance of the sheet. The control portion derives an amount of deviation between the discharge position of the sheet and a discharge reference position serving as a reference in the width direction in the sheet discharge portion based on a detection result of the discharge position detecting portion and controls the sheet shift portion according to the amount of deviation to correct a conveying position of the sheet in the sheet conveying portion.

An image forming apparatus according to another aspect of the present invention is provided with a printing device that forms an image on a sheet and the sheet conveying device that conveys the sheet on which the image is formed.

Advantageous Effects of the Invention

The present invention can provide the sheet conveying device capable of correcting the deviation of the sheet in the width direction occurring on the conveyance path of the sheet from the sheet correction mechanism to the discharge tray and can provide the image forming apparatus provided with the sheet conveying device.

DESCRIPTION OF EMBODIMENTS

The following describes an embodiment of the present invention with reference to the accompanying drawings. It should be noted that the following embodiment is an example of a specific embodiment of the present invention and should not limit the technical scope of the present invention.

Configuration of Image Forming Apparatus 10

Figure 1:
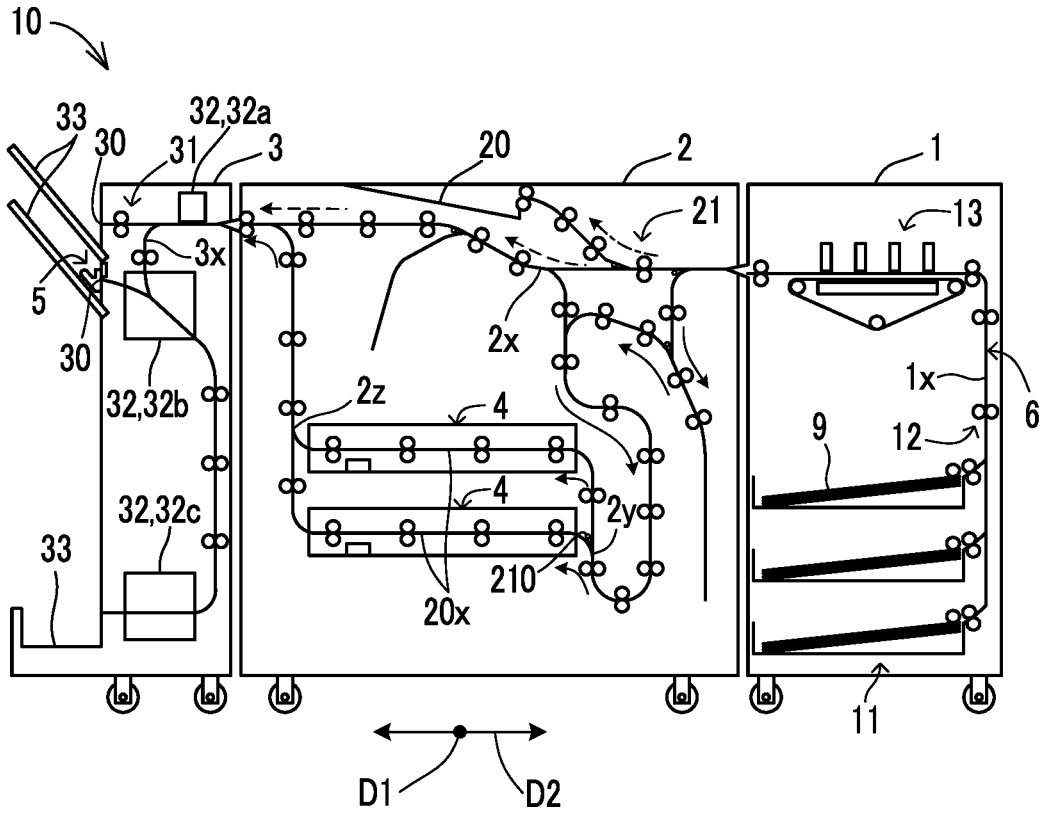
FIG. 1 is a diagram showing a configuration of an image forming apparatus provided with a sheet conveying device according to an embodiment.

As shown in FIG. 1, a sheet conveying device 6 according to an embodiment constitutes a part of an image forming apparatus 10. The image forming apparatus 10 is provided with a printing device 1, a relay conveying device 2, and a post-processing device 3.

In the present embodiment, the sheet conveying device 6 is composed of part of the printing device 1, part of the relay conveying device 2, and part of the post-processing device 3.

Figure 2:
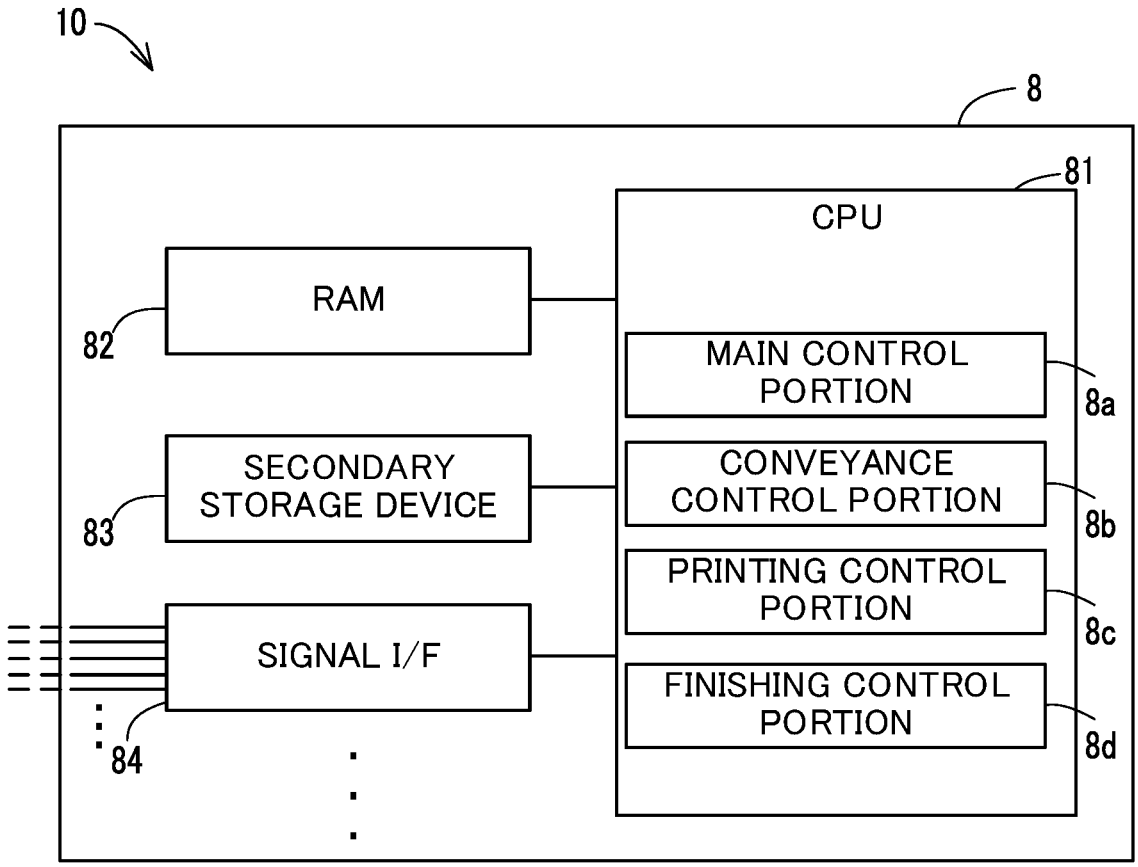
FIG. 2 is a block diagram showing a configuration of a control device in the sheet conveying device according to the embodiment.

As shown in FIG. 2, the image forming apparatus 10 is further provided with a control device 8 that controls the printing device 1, the relay conveying device 2, and the post-processing device 3.

A primary conveyance path 1*x* is formed inside the printing device 1, a secondary conveyance path 2*x* is formed inside the relay conveying device 2, and a tertiary conveyance path 3*x* is formed inside the post-processing device 3. The primary conveyance path 1*x*, the secondary conveyance path 2*x*, and the tertiary conveyance path 3*x* are paths on which sheets 9 are conveyed.

The printing device 1 is provided with a sheet storing portion 11, a primary conveying mechanism 12, and a printing portion 13. The primary conveying mechanism 12 feeds the sheets 9 housed in the sheet storing portion 11 to the primary conveyance path 1$x$ one by one and conveys the sheets 9 along the primary conveyance path 1$x$.

The printing portion 13 executes a printing process of forming images on the sheets 9 conveyed along the primary conveyance path 1$x$. The printing portion 13 shown in FIG. 1 executes the printing process by an inkjet printing method. The printing portion 13 may execute the printing process by other methods such as an electrophotographic method.

The primary conveying mechanism 12 feeds the sheets 9 after image formation from the primary conveyance path 1$x$ to the secondary conveyance path 2$x$ inside the relay conveying device 2.

The relay conveying device 2 transfers the sheets 9 after the image formation delivered from the printing device 1 to the post-processing device 3. The relay conveying device 2 is provided with a secondary conveying mechanism 21 and one or more sheet correction mechanisms 4. In the example shown in FIG. 1, the relay conveying device 2 is provided with two sheet correction mechanisms 4.

The secondary conveying mechanism 21 conveys the sheets 9 delivered from the printing device 1 along the secondary conveyance path 2$x$ and feeds the sheets 9 to the post-processing device 3. The secondary conveying mechanism 21 can execute a forward conveyance process of feeding the sheets 9 to the post-processing device 3 with the orientation of the sheets 9 delivered from the printing device 1 unchanged and a reverse conveyance process of feeding the sheets 9 to the post-processing device 3 with the orientation of the sheets 9 delivered from the printing device 1 reversed. The secondary conveying mechanism 21 is an example of a sheet conveying portion.

In FIG. 1, broken line arrows indicate an example of the conveyance route of the sheets 9 in the forward conveyance process and solid line arrows indicate an example of the conveyance routes of the sheets 9 in the reverse conveyance process.

In addition, the relay conveying device 2 is provided with an intermediate discharge tray 20. The secondary conveying mechanism 21 can also execute an intermediate discharge process of discharging the sheets 9 delivered from the printing device 1 to the intermediate discharge tray 20. In FIG. 1, an alternate long and short dash line arrow indicates the conveyance route of the sheets 9 in the intermediate discharge process.

In the description below, a horizontal direction orthogonal to a conveying direction of the sheets 9 in the primary conveyance path 1$x$, the secondary conveyance path 2$x$, and the tertiary conveyance path 3$x$ is referred to as "first direction D1", and a horizontal direction orthogonal to the first direction D1 is referred to as "second direction D2".

The first direction D1 corresponds to the width direction of the sheets 9 conveyed along the primary conveyance path 1$x$, the secondary conveyance path 2$x$, and the tertiary conveyance path 3$x$. In the present embodiment, the front-rear direction of the image forming apparatus 10 corresponds to the first direction D1. Similarly, the left-right direction of the image forming apparatus 10 corresponds to the second direction D2.

The sheet correction mechanisms 4 are disposed at certain points on the secondary conveyance path 2$x$. The sheet correction mechanisms 4 move the sheets 9 in the first direction D1.

In the image forming apparatus 10, the positions of the sheets 9 in the first direction D1 may be shifted while the primary conveying mechanism 12, the secondary conveying mechanism 21, and the post-processing device 3 convey the sheets 9. The sheet correction mechanisms 4 correct the deviation of the sheets 9 in the first direction D1.

The secondary conveyance path 2$x$ includes multiple parallel conveyance paths 20$x$ extending in parallel from a branch point 2$y$ to a merge point 2$z$. The secondary conveying mechanism 21 is provided with a route switching mechanism 210 for selectively guiding the sheets 9 that have reached the branch point 2$y$ to one of the multiple parallel conveyance paths 20$x$.

When a continuous printing process is executed, the route switching mechanism 210 guides multiple sheets 9 sequentially conveyed to the branch point 2$y$ to the multiple parallel conveyance paths 20$x$ in a predetermined order. In the continuous printing process, the printing process is continuously executed on the multiple sheets 9.

In the example shown in FIG. 1, the secondary conveyance path 2$x$ includes two parallel conveyance paths 20$x$ serving as paths of the sheets 9 in the reverse conveyance process.

The two sheet correction mechanisms 4 are respectively disposed on the two parallel conveyance paths 20$x$ at the certain points on the secondary conveyance path 2$x$. In the continuous printing process, the route switching mechanism 210 guides the sheets 9 that have reached the branch point 2$y$ alternately to the two parallel conveyance paths 20$x$.

Accordingly, the sheets 9 can be conveyed to one of the sheet correction mechanisms 4 without waiting for the other sheet correction mechanism 4 to finish performing the process on the preceding sheets 9. This prevents a reduction in efficiency in conveying the sheets 9 in the continuous printing process.

The post-processing device 3 is provided with a tertiary conveying mechanism 31, one or more sheet finishing mechanisms 32, and one or more discharge trays 33. The tertiary conveying mechanism 31 conveys the sheets 9 delivered from the relay conveying device 2 along the tertiary conveyance path 3$x$ and discharges the sheets 9 conveyed through the sheet finishing mechanisms 32 from discharge ports 30 to the discharge trays 33. The discharge ports 30 correspond to exits of the tertiary conveyance path 3$x$. The tertiary conveying mechanism 31 is an example of a sheet discharge portion disposed downstream of the secondary conveying mechanism 21. The discharge ports 30 are formed in the housing of the post-processing device 3 that includes the tertiary conveying mechanism 31.

In the present embodiment, the primary conveying mechanism 12, the secondary conveying mechanism 21, and the tertiary conveying mechanism 31 respectively convey the sheets 9 along the primary conveyance path 1$x$, the secondary conveyance path 2$x$, and the tertiary conveyance path 3$x$; and constitute a conveying mechanism 12, 21, 31 that discharges the sheets 9 from the tertiary conveyance path 3$x$ to the discharge trays 33. In addition, the conveying mechanism 12, 21, 31, the sheet correction mechanisms 4, and a discharged sheet alignment mechanism 5 constitute the sheet conveying device 6.

In the example shown in FIG. 1, the sheet finishing mechanisms 32 include a punching mechanism 32$a$, a stapling mechanism 32$b$, and a sheet folding mechanism 32$c$. The punching mechanism 32$a$ punches holes in sheets 9. The stapling mechanism 32$b$ stacks and aligns multiple sheets 9 and staples the multiple aligned sheets 9. The sheet folding mechanism 32$c$ creases a sheet 9 or multiple stacked sheets 9.

The post-processing device 3 is further provided with the discharged sheet alignment mechanism 5. The discharged sheet alignment mechanism 5 aligns the positions of the sheets 9, in the first direction D1, discharged onto the discharge trays 33 with a predetermined reference position.

As shown in FIG. 2, the control device 8 is provided with a CPU (Central Processing Unit) 81, a RAM (Random Access Memory) 82, a secondary storage device 83, and peripherals such as a signal interface 84.

The CPU 81 is a processor that executes computer programs to execute various types of data processing and control. The RAM 82 is a computer-readable volatile storage device. The RAM 82 primarily stores the computer programs executed by the CPU 81 and data that is output or consulted by the CPU 81 during execution of various types of processing.

The secondary storage device 83 is a computer-readable nonvolatile storage device. The secondary storage device 83 can store and update the computer programs and various types of data. For example, either a flash memory or a hard disk drive, or both, may be used as the secondary storage device 83.

The signal interface 84 converts signals output by various types of sensors into digital data and transmits the converted digital data to the CPU 81. Furthermore, the signal interface 84 converts control commands output by the CPU 81 into control signals and transmits the control signals to components to be controlled.

The CPU 81 includes multiple processing modules that are implemented when the computer programs are executed. The processing modules include a main control portion 8*a*, a conveyance control portion 8*b*, a printing control portion 8*c*, and a post-processing portion 8*d*.

The main control portion 8*a* executes, for example, control that causes various types of processing to be started in response to operations on an operation portion (not shown) and control that causes a display portion (not shown) to display information.

The conveyance control portion 8*b* controls the sheet conveying device 6. The printing control portion 8*c* causes the printing portion 13 to execute the printing process in synchronization with the conveyance of the sheets 9 by the primary conveying mechanism 12. The post-processing portion 8*d* controls the sheet finishing mechanisms 32.

Figure 3:
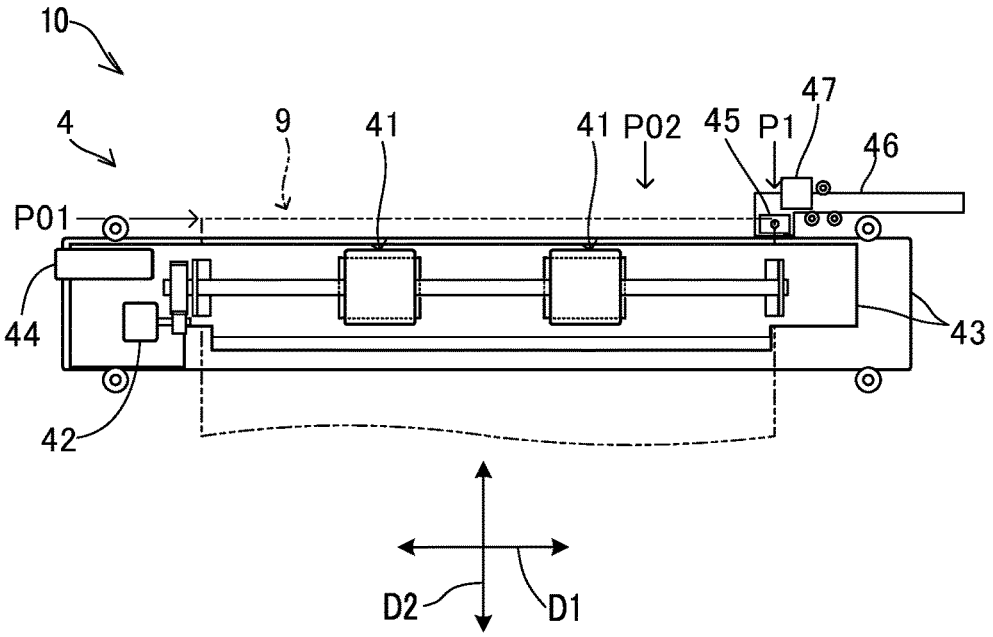
FIG. 3 is a diagram showing a configuration of a sheet correction mechanism in the sheet conveying device according to the embodiment.

As shown in FIG. 3, each of the sheet correction mechanisms 4 in the present embodiment is provided with two pairs of registration rollers 41, a roller drive mechanism 42, a roller support portion 43, a first shift drive portion 44, a sheet detection sensor 45, a sensor support portion 46, and a second shift drive portion 47.

The pairs of registration rollers 41 are rotatably supported by the roller support portion 43. The roller drive mechanism 42 rotationally drives the pairs of registration rollers 41. The pairs of registration rollers 41 rotate while holding a sheet 9 in between to convey the sheet 9. The conveyance control portion 8*b* controls the roller drive mechanism 42 to rotate and stop the pairs of registration rollers 41.

The roller support portion 43 supports the pairs of registration rollers 41 and the roller drive mechanism 42 while being supported to be movable in the first direction D1. The roller support portion 43 also serves as a sheet guide that partially forms the secondary conveyance path 2*x*.

The first shift drive portion 44 is a mechanism for moving the roller support portion 43 in the first direction D1. The roller support portion 43 and the first shift drive portion 44 are examples of a roller shift portion that moves the pairs of registration rollers 41 in the first direction D1. In addition, the pairs of registration rollers 41, the roller support portion 43, and the first shift drive portion 44 are examples of a sheet shift portion that moves the sheet 9 in the first direction D1.

The conveyance control portion 8*b* controls the first shift drive portion 44 to adjust the position of the sheet 9, in the first direction D1, held by the pairs of registration rollers 41.

The sheet detection sensor 45 detects the sheet 9 held by the pairs of registration rollers 41. For example, a reflective optical sensor or the like is used as the sheet detection sensor 45.

The sensor support portion 46 supports the sheet detection sensor 45 while being supported to be movable in the first direction D1. The second shift drive portion 47 is a mechanism for moving the sensor support portion 46 in the first direction D1. The sensor support portion 46 and the second shift drive portion 47 are examples of a sensor shift portion. The conveyance control portion 8*b* controls the second shift drive portion 47 to adjust the position of the sheet detection sensor 45 in the first direction D1.

The conveyance control portion 8*b* controls the roller drive mechanism 42, the first shift drive portion 44, and the second shift drive portion 47. The sheet correction mechanism 4 corrects the skew of the sheet 9 that has reached the sheet correction mechanism 4 and moves the sheet 9 to a reference conveying position in the first direction D1 according to the control by the conveyance control portion 8*b*. The reference conveying position is a position in the first direction D1 set in advance according to the size of the sheet 9.

Specifically, the conveyance control portion 8*b* stops the rotation of the pairs of registration rollers 41 before the sheet 9 reaches the sheet correction mechanism 4. This causes the leading edge of the sheet 9 that has reached the sheet correction mechanism 4 to abut on the pairs of registration rollers 41. Thus, the pairs of registration rollers 41 correct the skew of the sheet 9 that is brought into contact with the pairs of registration rollers 41 while the rotation of the pairs of registration rollers 41 is stopped.

Furthermore, the conveyance control portion 8*b* temporarily rotates the pairs of registration rollers 41 and then stops the rotation. Specifically, the conveyance control portion 8*b* temporarily rotates the pairs of registration rollers 41 until the leading edge of the sheet 9 reaches a predetermined adjustment position P01, and then stops the rotation. Thus, the pairs of registration rollers 41 hold the sheet 9 with the leading edge of the sheet 9 located at the adjustment position P01.

The adjustment position P01 is a position downstream of the pairs of registration rollers 41 in the sheet conveying direction. When the leading edge of the sheet 9 is located at the adjustment position P01, the sheet detection sensor 45 can detect the sheet 9 at any position in the first direction D1.

For example, a sheet sensor (not shown) detects that the sheet 9 has reached a predetermined position upstream of the pairs of registration rollers 41 in the sheet conveying direction. The conveyance control portion 8*b* temporarily rotates the pairs of registration rollers 41 from a standstill for a predetermined period of time after a predetermined period of time has passed since the detection of the sheet 9 by the sheet sensor. This causes the sheet 9 to stop with the leading edge located at the adjustment position P01.

In addition, the sheet detection sensor 45 of the sheet correction mechanism 4 may also serve as a sensor that detects that the leading edge of the sheet 9 has reached the adjustment position P01. In this case, the conveyance control portion 8*b* shifts the sheet detection sensor 45 in advance to a waiting position P02 in the first direction D1 before the sheet 9 reaches the pairs of registration rollers 41.

The sheet detection sensor 45 disposed at the waiting position P02 can detect a sheet 9 with any anticipated width when the sheet 9 reaches the adjustment position P01.

The conveyance control portion 8*b* stops the pairs of registration rollers 41 when the sheet detection sensor 45 disposed at the waiting position P02 detects the sheet 9. This causes the sheet 9 to stop with the leading edge located at the adjustment position P01.

Moreover, the conveyance control portion 8*b* controls the second shift drive portion 47 to move the sheet detection sensor 45 to a target edge position P1 corresponding to the reference conveying position of the sheet 9. Furthermore, the conveyance control portion 8*b* controls the first shift drive portion 44 to move the pairs of registration rollers 41 from the starting point to the ending point, in the first direction D1, set in advance.

For example, the starting point corresponds to the position of one end of a movable range of the pairs of registration rollers 41 in the first direction D1, whereas the ending point corresponds to the position of another end of the movable range.

While moving the pairs of registration rollers 41 in the first direction D1, the conveyance control portion 8*b* stops the movement of the pairs of registration rollers 41 when the detection result of the sheet detection sensor 45 indicates an edge detection change set in advance.

The sheet detection sensor 45 detects the sheet 9 while the roller support portion 43 and the first shift drive portion 44 move the pairs of registration rollers 41 to detect the position of the sheet 9 in the first direction D1. The sheet detection sensor 45, the sensor support portion 46, and the second shift drive portion 47 are examples of a conveying position detecting portion that detects the position of the sheet 9 in the first direction D1 on the secondary conveyance path 2*x*. The sheet correction mechanism 4 corrects the conveying position of the sheet 9 in the first direction D1 to the predetermined reference conveying position.

In a case where the direction from the starting point to the ending point corresponds to a direction in which the sheet 9 approaches the target edge position P1, the edge detection change corresponds to a change from a state where the sheet 9 is not detected by the sheet detection sensor 45 to a state where the sheet 9 is detected.

In a case where the direction from the starting point to the ending point corresponds to a direction in which the sheet 9 moves away from the target edge position P1, the edge detection change corresponds to a change from the state where the sheet 9 is detected by the sheet detection sensor 45 to the state where the sheet 9 is not detected.

The position of the sheet 9 in the first direction D1 is adjusted to the reference conveying position by stopping the movement of the pairs of registration rollers 41 when the detection result of the sheet detection sensor 45 indicates the edge detection change. Subsequently, the pairs of registration rollers 41 rotate according to the control by the conveyance control portion 8*b* to convey the sheet 9 downstream.

It is noted that the secondary conveying mechanism 21 is provided with pairs of upstream rollers (not shown) disposed upstream of the pairs of registration rollers 41 in the sheet conveying direction. Both the pairs of registration rollers 41 and the pairs of upstream rollers may hold the sheet 9 in between while the leading edge of the sheet 9 is located at the adjustment position P01.

In this case, the secondary conveying mechanism 21 is provided with a roller separating mechanism for separating the pairs of upstream rollers from the sheet 9. The conveyance control portion 8*b* controls the roller separating mechanism to separate the pairs of upstream rollers from the sheet 9 before moving the pairs of registration rollers 41 in the first direction D1. Furthermore, the conveyance control portion 8*b* controls the roller separating mechanism to bring the pairs of upstream rollers into contact with the sheet 9 when the adjustment of position of the sheet 9 in the first direction D1 is finished.

Figure 4:
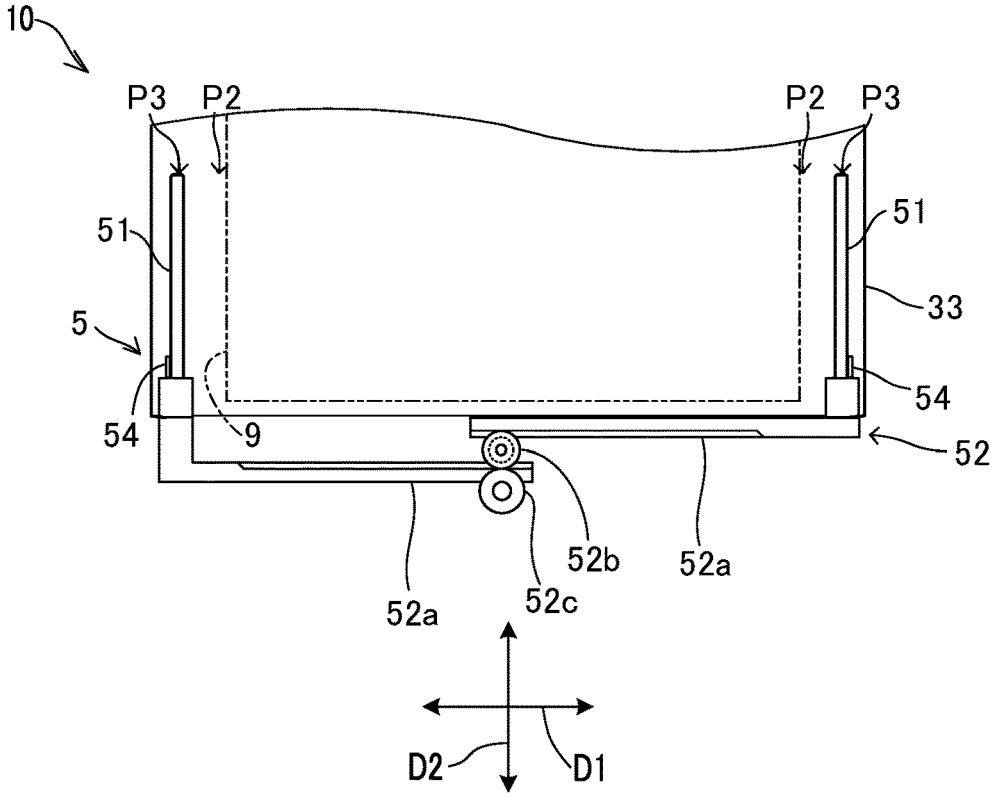
FIG. 4 is a diagram showing a configuration of a discharged sheet alignment mechanism in the sheet conveying device according to the embodiment.

As shown in FIG. 4, the discharged sheet alignment mechanism 5 is provided with a pair of paper cursors 51 and a cursor moving mechanism 52.

The pair of paper cursors 51 are supported by a frame of the post-processing device 3. The pair of paper cursors 51 are supported on the discharge tray 33 to be movable in the first direction D1 inward to be closer to each other and outward to be separated from each other.

When a sheet 9 is discharged to the discharge tray 33, the cursor moving mechanism 52 moves the pair of paper cursors 51 from a retraction position P3 to a discharge reference position P2. The discharge reference position P2 corresponds to a sheet width set in advance, and the retraction position P3 is located outside the discharge reference position P2.

The pair of paper cursors 51 align the sheet at the discharge reference position P2 by moving from both sides of the sheet 9 on the discharge tray 33 to the discharge reference position P2. The discharge reference position P2 is a position serving as a reference in the first direction D1 in the sheet discharge portion 31.

In the present embodiment, the cursor moving mechanism 52 is provided with a pair of rack gears 52*a* respectively connected to the pair of paper cursors 51 and a pinion gear 52*b* meshing with the pair of rack gears 52*a*. The pair of rack gears 52*a* and the pinion gear 52*b* constitute a rack and pinion mechanism.

Furthermore, the cursor moving mechanism 52 is provided with a gear drive motor 52*c* that rotationally drives the pinion gear 52*b*. The conveyance control portion 8*b* of the control device 8 controls the rotation direction of the gear drive motor 52*c* to move the pair of paper cursors 51 inward or outward.

The conveyance control portion 8*b* of the control device 8 sets the discharge reference position P2 corresponding to the sheet width set in advance. Furthermore, when the sheet 9 is discharged to the discharge tray 33, the conveyance control portion 8*b* controls the gear drive motor 52*c* to move the pair of paper cursors 51 from the retraction position P3 to the discharge reference position P2 and, furthermore, from the discharge reference position P2 to the retraction position P3.

The control over the movement of the pair of paper cursors 51 by the conveyance control portion 8*b* causes the pair of paper cursors 51 that move to the discharge reference position P2 to align the sheet 9 on the discharge tray 33 with an appropriate position. It is noted that the retraction position P3 is a position outside the discharge reference position P2.

In a case where the conveyance path of the sheet 9 downstream of the sheet correction mechanism 4 is long, the position of the sheet 9 in the first direction D1 may be shifted again before the sheet 9 is discharged to the discharge tray 33.

In a case where the deviation of the sheet 9 in the first direction D1 when the sheet 9 is discharged onto the discharge tray 33 is too large, the sheet 9 may be discharged onto one of the pair of paper cursors 51. In this case, the discharged sheet alignment mechanism 5 cannot align the sheet 9 with the reference position.

The sheet conveying device 6 is provided with a configuration capable of correcting the deviation of the sheet 9 in the first direction D1 occurring on the conveyance path of the sheet 9 between the sheet correction mechanism 4 and the discharge tray 33. The following describes the configuration.

In the present embodiment, the discharged sheet alignment mechanism 5 is further provided with a pair of cursor contact sensors 54 (see FIG. 4). The pair of cursor contact sensors 54 detect that the pair of paper cursors 51 are brought into contact with the side edges of the sheet 9.

For example, the pair of cursor contact sensors 54 may be pressure sensors. The pressure sensors may be, for example, strain sensors. The pressure sensors detect pressure the respective paper cursors 51 receive from the sheet 9.

When the pair of paper cursors 51 move from the retraction position P3 to the discharge reference position P2 and are brought into contact with the respective side edges of the sheet 9, the cursor contact sensors 54 detect pressure applied to the paper cursors 51 by the sheet 9. Accordingly, detection of pressure exceeding a predetermined reference pressure by the cursor contact sensors 54 indicates that the paper cursors 51 are brought into contact with the side edges of the sheet 9 on the discharge tray 33.

In the description below, the amount of deviation of the sheet 9 discharged onto the discharge tray 33 from the reference position in the first direction D1 is referred to as "amount of discharge deviation". The main control portion 8*a* executes a discharge deviation derivation process of deriving the amount of discharge deviation.

In the discharge deviation derivation process, the main control portion 8*a* derives the amount of discharge deviation according to a timing when one of the pair of cursor contact sensors 54 detects the contact between one of the pair of paper cursors 51 and the side edge of the sheet 9 earlier than the other cursor contact sensor 54 while the pair of paper cursors 51 move from the retraction position P3 to the discharge reference position P2.

Specifically, the main control portion 8*a* measures time from when the pair of paper cursors 51 start to move from the retraction position P3 to the discharge reference position P2 to when the contact between one of the pair of paper cursors 51 and the corresponding side edge of the sheet 9 is first detected by one of the pair of cursor contact sensors 54 as a position determination time. The position determination time indicates the position of the sheet 9, in the first direction D1, discharged onto the discharge tray 33. The position will be referred to as "discharge position" below. The position determination time is an example of a detection time. The main control portion 8*a* that measures the position determination time is an example of a measurement portion.

The main control portion 8*a* derives the amount of discharge deviation according to the difference between the position determination time and a predetermined reference time corresponding to the discharge reference position P2. The reference time is a time required for the pair of paper cursors 51 to move from the retraction position P3 to the discharge reference position P2.

The main control portion 8*a* applies the difference between the position determination time and the reference time to a predetermined conversion formula or a conversion table to derive the amount of discharge deviation. The amount of discharge deviation is the amount of deviation of the sheet 9 in the first direction D1 occurring when the sheet 9 is conveyed from the sheet correction mechanism 4 to the discharge tray 33.

In addition, the amount of discharge deviation includes information about a shift direction of the sheet 9 relative to the reference position. Specifically, the shift direction is determined by which of the pair of cursor contact sensors 54 detects the contact between the paper cursors 51 and the side edges of the sheet 9 first.

It is noted that the pair of cursor contact sensors 54 and the main control portion 8*a* that measures the position determination time are examples of a discharge position detecting portion that detects the discharge position of the sheet 9.

On the other hand, the conveyance control portion 8*b* corrects the target edge position P1 in the sheet correction mechanism 4 according to the amount of discharge deviation derived in the discharge deviation derivation process. Correcting the target edge position P1 means correcting the reference conveying position of the sheet 9 in the sheet correction mechanism 4. When the reference conveying position is corrected, the conveyance control portion 8*b* controls the sheet correction mechanism 4 according to the reference conveying position after correction. Thus, the conveyance control portion 8*b* corrects the conveying position of the sheet 9 in the secondary conveying mechanism 21.

Specifically, the conveyance control portion 8*b* corrects the target edge position P1 in a direction opposite the shift direction indicated by the amount of discharge deviation by a distance corresponding to the amount of discharge deviation. Thus, the target edge position P1 is corrected such that the amount of discharge deviation approaches zero.

In the present embodiment, the main control portion 8*a* that executes the discharge deviation derivation process and the conveyance control portion 8*b* that controls the sheet correction mechanisms 4 constitute part of the sheet conveying device 6. Controlling the sheet correction mechanisms 4 is an example of controlling the conveyance of the sheets 9.

The adoption of the sheet conveying device 6 enables the correction of the deviation of the sheets 9 in the first direction D1 occurring on the conveyance paths of the sheets 9 between the sheet correction mechanisms 4 and the discharge tray 33.

First Application Example

In the sheet conveying device 6, a line sensor of the CIS (Contact Image Sensor) type disposed at the discharge port of the tertiary conveyance path 3*x* so as to extend in the first direction D1 may be used as the discharge deviation detection portion that detects the amount of discharge deviation.

The line sensor detects the positions of the side edges of the sheets 9 discharged from the tertiary conveyance path 3*x*. In the present application example, in the discharge deviation derivation process, the main control portion 8*a* derives the amount of discharge deviation according to the difference between predetermined reference edge positions corresponding to the width of the sheets 9 set in advance and the positions of the side edges of the sheets 9 detected by the line sensor.

Second Application Example

As shown in FIG. 1, the image forming apparatus 10 is provided with the multiple discharge ports 30 and the multiple discharge trays 33. In this case, the tertiary conveying mechanism 31 selectively discharges the sheets 9 to one of the multiple discharge trays 3.

That is, the conveyance control portion 8*b* selects the destination of the sheets 9 from the multiple discharge trays 33. Furthermore, the conveyance control portion 8*b* causes the tertiary conveying mechanism 31 to execute a process of discharging the sheets 9 to the selected destination.

Multiple pairs of cursor contact sensors 54 may be provided so as to correspond to the multiple discharge trays 33. That is, the post-processing device 3 is provided with multiple pairs of cursor contact sensors 54 corresponding to the multiple discharge trays 33. In this case, the main control portion 8*a* measures the position determination time for the pair of cursor contact sensors 54 corresponding to the destination of the sheets 9 among the multiple discharge trays 33.

Furthermore, the main control portion 8*a* corrects the reference conveying position according to the detection result of the pair of cursor contact sensors 54 corresponding to the destination of the sheets 9 among the multiple discharge trays 33. That is, the main control portion 8*a* and the conveyance control portion 8*b* correct the conveying position of the sheets 9 according to the detection result of one of the multiple pairs of cursor contact sensors 54 corresponding to the selected destination. These application examples may be adopted by the present invention.

The invention claimed is:

1. A sheet conveying device comprising:

a sheet conveying portion configured to convey a sheet along a conveyance path;

a sheet discharge portion disposed downstream of the sheet conveying portion in a sheet conveying direction and configured to discharge the sheet from a discharge port to a discharge tray;

a sheet shift portion disposed on the conveyance path and configured to move the sheet in a width direction orthogonal to the sheet conveying direction;

a conveying position detecting portion configured to detect a position of the sheet in the width direction on the conveyance path;

a discharge position detecting portion configured to detect a discharge position of the sheet, in the width direction, discharged onto the discharge tray; and a control portion configured to control conveyance of the sheet, wherein the control portion derives an amount of deviation between the discharge position of the sheet and a discharge reference position serving as a reference in the width direction in the sheet discharge portion based on a detection result of the discharge position detecting portion and controls the sheet shift portion according to the amount of deviation to correct a conveying position of the sheet in the sheet conveying portion.

2. The sheet conveying device according to claim 1, further comprising:

a pair of paper cursors supported on the discharge tray to be movable in the width direction inward to be closer to each other and outward to be separated from each other and configured to align the sheet at the discharge reference position by moving from both sides of the sheet to the discharge reference position; and a cursor moving mechanism configured to move the pair of paper cursors from a retraction position to the discharge reference position when the sheet is discharged to the discharge tray, the discharge reference position corresponding to a sheet width set in advance, the retraction position being located outside the discharge reference position, wherein the discharge position detecting portion includes:

a pair of cursor contact sensors configured to detect that the pair of paper cursors are brought into contact with side edges of the sheet; and a measurement portion configured to measure a detection time from when the pair of paper cursors start to move from the retraction position to the discharge reference position to when contact between one of the pair of paper cursors and the corresponding side edge of the sheet is first detected by one of the pair of cursor contact sensors; and the control portion derives the amount of deviation according to a difference between the detection time and a reference time that is a time required for the pair of paper cursors to move from the retraction position to the discharge reference position.

3. The sheet conveying device according to claim 2, wherein the pair of cursor contact sensors are pressure sensors.

4. The sheet conveying device according to claim 1, wherein the sheet shift portion includes:

a pair of registration rollers configured to correct a skew of the sheet that is brought into contact with the pair of registration rollers while the rotation of the pair of registration rollers is stopped, and then to temporarily rotate and stop to hold the sheet; and a roller shift portion configured to move the pair of registration rollers that hold the sheet in the width direction, the conveying position detecting portion includes:

a sheet detection sensor configured to detect the sheet held by the pair of registration rollers; and a sensor shift portion supporting the sheet detection sensor and configured to move the sheet detection sensor in the width direction, the sheet detection sensor detects the sheet while the roller shift portion moves the registration rollers to detect the position of the sheet in the width direction, and the control portion controls the sensor shift portion to move the sheet detection sensor to a target position corresponding to a size of the sheet and, furthermore, controls the roller shift portion to stop the movement of the registration rollers when a detection result of the sheet detection sensor indicates a predetermined change while the registration rollers are being moved.

5. The sheet conveying device according to claim 1, wherein the discharge port is one of a plurality of discharge ports formed in a housing provided with the sheet discharge portion, the discharge tray is one of a plurality of discharge trays corresponding to the plurality of discharge ports, the discharge position detecting portion is one of a plurality of discharge position detecting portions corresponding to the plurality of discharge trays, and the control portion selects a destination of the sheet from the plurality of discharge trays, causes the sheet discharge portion to execute a process of discharging the sheet to the selected destination, and corrects the conveying position of the sheet according to the detection result of one of the plurality of discharge position detecting portions corresponding to the selected destination.

6. An image forming apparatus comprising:

a printing device configured to form an image on a sheet;

the sheet conveying device according to claim 1 configured to convey the sheet on which the image is formed;

a relay conveying device connected to the printing device and configured to convey the sheet discharged from the printing device; and a post-processing device connected to the relay conveying device, configured to perform post-processing on the sheet discharged from the relay conveying device, and configured to stack the sheet on the discharge tray, wherein the sheet conveying portion is provided in the relay conveying device, and the sheet discharge portion is provided in the post-processing device.

7. The image forming apparatus according to claim 6, wherein the relay conveying device includes two parallel conveyance paths disposed in parallel, the two parallel conveyance paths are each provided with the sheet shift portion and the conveying position detecting portion, and in a case where the printing device executes a continuous printing process, the control portion guides the sheets alternately to the two parallel conveyance paths.

* * * * *